US007990341B2

(12) United States Patent
Itokawa et al.

(10) Patent No.: US 7,990,341 B2
(45) Date of Patent: Aug. 2, 2011

(54) PLASMA DISPLAY DEVICE

(75) Inventors: Naoki Itokawa, Tokyo (JP); Tetsuya Sakamoto, Tokyo (JP); Takayuki Kobayashi, Tokyo (JP); Tomokatsu Kishi, Tokyo (JP); Yasunobu Hashimoto, Tokyo (JP)

(73) Assignee: Fujitsu Hitachi Plasma Display Limited, Miyazaki-Ken (JP)

( * ) Notice: Subject to any disclaimer, the term of this patent is extended or adjusted under 35 U.S.C. 154(b) by 937 days.

(21) Appl. No.: 11/919,995

(22) PCT Filed: Jul. 26, 2005

(86) PCT No.: PCT/JP2005/013624

§ 371 (c)(1),
(2), (4) Date: Nov. 7, 2007

(87) PCT Pub. No.: WO2007/013139

PCT Pub. Date: Feb. 1, 2007

(65) Prior Publication Data

US 2009/0096717 A1 Apr. 16, 2009

(51) Int. Cl.
*G09G 3/28* (2006.01)

(52) U.S. Cl. ..... 345/60; 345/63

(58) Field of Classification Search ..... 345/60, 345/63

See application file for complete search history.

(56) References Cited

U.S. PATENT DOCUMENTS

| | | | | |
|---|---|---|---|---|
| 6,414,656 | B1 * | 7/2002 | Hong | 345/60 |
| 6,466,186 | B1 | 10/2002 | Shimizu et al. | |
| 6,842,159 | B2 | 1/2005 | Kishi et al. | |
| 7,023,406 | B1 | 4/2006 | Nunomura et al. | |
| 7,133,008 | B2 * | 11/2006 | Naganuma | 345/63 |
| 7,453,423 | B2 * | 11/2008 | Mizobata | 345/63 |
| 2002/0003515 | A1 | 1/2002 | Lee et al. | |
| 2002/0084953 | A1 * | 7/2002 | Yoon et al. | 345/60 |
| 2003/0063049 | A1 * | 4/2003 | Eo et al. | 345/60 |
| 2003/0179162 | A1 * | 9/2003 | Ooe et al. | 345/63 |
| 2004/0125050 | A1 * | 7/2004 | Ohira et al. | 345/60 |
| 2004/0164930 | A1 | 8/2004 | Hashimoto et al. | |
| 2004/0201553 | A1 | 10/2004 | Itokawa et al. | |

(Continued)

FOREIGN PATENT DOCUMENTS

JP 7-44127 2/1995

(Continued)

OTHER PUBLICATIONS

International Search Report (with English Translation) issued in International Application No. PCT/JP2005/013624, dated Nov. 1, 2005.

*Primary Examiner* — Richard Hjerpe

*Assistant Examiner* — Sahlu Okebato

(74) *Attorney, Agent, or Firm* — McDermott Will & Emery LLP

(57) ABSTRACT

A technique which enables improvement of luminance and reduction of consumption power in a sustain discharge driving of a four-electrode structure PDP, particularly, by devising driving method to Z electrodes. In this plasma display device, a sustain discharge by a method to apply a narrow pulse to the Z electrode and a method to apply a fixed potential to the Z electrode are switched according to a judgment of range of display load ratio in driving sustain discharge from a controller and driver to the PDP and used.

6 Claims, 11 Drawing Sheets

U.S. PATENT DOCUMENTS

| | | | | |
|---|---|---|---|---|
| 2005/0174305 | A1* | 8/2005 | Chae et al. | 345/60 |
| 2008/0278417 | A1* | 11/2008 | Sasaki et al. | 345/63 |

FOREIGN PATENT DOCUMENTS

| | | |
|---|---|---|
| JP | 8-306318 | 11/1996 |
| JP | 2000-172223 | 6/2000 |
| JP | 2000-322025 | 11/2000 |
| JP | 2002-93329 | 3/2002 |
| JP | 2002-110047 | 4/2002 |
| JP | 2004-318078 | 11/2004 |
| JP | 2005-70727 | 3/2005 |
| WO | WO 00/05740 | 2/2000 |

* cited by examiner

<DRIVING WAVEFORM OF 1 SUBFIELD - NARROW PULSE METHOD>

<FIXED POTENTIAL METHOD – SUSTAIN DISCHARGE>

<NARROW PULSE METHOD – SUSTAIN DISCHARGE>

*FIG. 9C*

| | FIXED POTENTIAL METHOD | NARROW PULSE METHOD |
|---|---|---|
| REACTIVE POWER | SMALL | RATHER LARGE |
| DISCHARGE POWER | RATHER LARGE | SMALL |

PLASMA DISPLAY DEVICE

RELATED APPLICATION

This application is the U.S. National Phase under 35 U.S.C. §371 of International Application No. PCT/JP2005/013624, filed on Jul. 26, 2005, the disclosure of which Application is incorporated by reference herein.

TECHNICAL FIELD

The present invention relates to a technique for a plasma display panel (abbreviated as PDP) and a display device, in particular, for a four-electrode structure PDP having first, second, third electrodes (referred to as X, Y, Z, respectively) and a fourth electrode which crosses the above electrodes (referred to as A), a method of driving and controlling a PDP, and a plasma display device which is structured to include a PDP module comprising a PDP and driver circuits, a chassis and the like.

BACKGROUND ART

As a PDP to realize high emission efficiency, a four-electrode structure PDP has been proposed. The four-electrode structure PDP has a structure in which, in addition to X, Y electrodes which are approximately in parallel in a first substrate, Z electrodes are arranged therebetween, and by use of these, a sustain discharge is performed. As the method and system of driving the Z electrodes, there are a method of giving a fixed potential (referred to as first method and fixed potential method) and a method of giving a narrow width pulse (abbreviated as narrow pulse) (referred to as second method and narrow pulse method). These two methods themselves are well known techniques.

By giving a pulse of appropriate timing conditions as the narrow pulse method to the Z electrodes of the PDP from driver side, it is possible to generate a multistep sustain discharge with a lower sustain discharge voltage (Vs) than that in the case of the fixed potential method, that is, at a low electron temperature. The above Vs is the voltage used in sustain discharge driving to X, Y, Z. Accordingly, even with a same long gap discharge between XY of cells, by the narrow pulse method, it is possible to realize a discharge with higher emission efficiency with less excitation energy loss.

A technique of the four-electrode structure PDP is described in, for example, Patent Document 1.

Patent Document 1: Japanese Patent Application Laid-Open Publication No. 2002-110047

DISCLOSURE OF THE INVENTION

As a method of driving sustain discharge to Z electrodes in the four-electrode structure PDP, in the case of the narrow pulse method in comparison with the fixed potential method, that is, in the case when a sustain discharge is generated by applying a narrow pulse to Z electrodes, the discharge energy efficiency, that is, luminance and panel emission efficiency are improved. However, according to the number of pulses to be applied to Z electrodes (referred to as Z driving pulses and the like), a reactive power increases. As a result, the display load ratio in the PDP screen (field) display is small, and when the number of pulses for sustain discharge driving (abbreviated as number of sustain) becomes large, the reactive power occupies nearly half of power consumption of the sustain discharge system. The case when the number of sustain becomes large is due to the power control operation (to be described later). The reactive power is the power other than discharge power (that is, power used for discharge itself) which is consumed by the circuit itself in sustain discharge system.

With images of low display load ratio, the rate of reactive power increases in the power consumption of the sustain discharge system, and accordingly, in the driving system and method where reactive power per cycle increases like the narrow pulse method, the number of sustain must be limited. Therefore, it is impossible to obtain improved luminance. In FIG. 9C, characteristics of the above two systems are summarized.

The present invention has been made in consideration of the above problems in the prior art, and accordingly, an object of the present invention is to provide a technique to solve the above problems and to realize improvement of luminance of the PDP and an effect of reduction of power consumption comprehensively by devising the driving of the four-electrode structure PDP, in particular, the driving to Z electrodes in sustain discharge driving.

The typical ones of the inventions disclosed in this application will be briefly described as follows. In order to achieve the above object, there is provided a plasma display device including: a four-electrode structure PDP which has first and second electrodes (X, Y) arranged roughly in parallel in a first direction, a third electrode (Z) arranged between the XY, and a fourth electrode (A) arranged so as to cross the X, Y, Z in a second direction to be address electrodes; a driving circuit (driver) which drives the electrodes of the PDP; a circuit such as a control circuit (controller) which controls the driver and the like; and comprises the technical means described below.

The present device has a means which uses a plurality of kinds of driving waveform of sustain discharge with different characteristics by switching them in a drive control from the circuit to the PDP. In the present device, there is a means which combines a sustain discharge by a driving method (the above second method) where a narrow pulse is applied at appropriate timing to Z electrodes and a sustain discharge by a driving method (the above first method) where a fixed potential is given to the Z electrodes, and switches and uses these methods according to the display load ratio of the PDP screen in driving from the controller and driver to the electrode group of the PDP, in particular, in the control of sustain discharge driving. The present means is mainly realized by a sustain discharge drive control to the electrode group of the PDP on the basis of a judgment of the display load ratio by the controller and driver and a hardware implementation structure corresponding thereto.

In the present device, in order to increase the luminance, that is, to increase the number of sustain, on the basis of the judgment of the display load ratio of the PDP screen by the controller and driver, the narrow pulse method is selectively used to Z electrodes to drive display. Further, in the present device, in order to reduce the power consumption, on the basis of the display load ratio, the fixed potential method to Z electrodes is selectively used to drive display.

There are differences in characteristics of the emission efficiency, power and the like according to the display load ratio, and the luminance improvement and the power consumption reduction are generally in the relation of tradeoff. In the present device, according to an area (range) of the display load ratio, the above two methods are combined so as to take comprehensive balance between the luminance and the power consumption in the display drive control.

In the present device, by use of the fact that the minimum value of the sustain discharge voltage (Vs) becomes lower as the display load ratio is smaller, in the display drive control, the above first and second methods are switched and selected for use as in (1), (2) described below. In the present device, at least two areas (ranges) of the display load ratio are set for the present control of switching and selecting.

(1) In the present control, in an area where the display load ratio is large (high), the narrow pulse method as the above second method is employed. In the use of this system, in comparison with the fixed potential method, the sustain discharge is available at a lower Vs and the discharge emission efficiency is higher, thus high luminance can be attained.

(2) In the present control, in an area where the display load ratio is small (low), the fixed potential method as the above first method is employed. In this area, since the display load ratio is small, the sustain discharge is available at lower Vs. In the use of this system, in comparison with the narrow pulse method, driving with less reactive power is available and a large number of sustain (for example, 60 kHz) can be supplied, thus high luminance can be attained.

In the present device, a plurality of divided areas (ranges) are set in the entire (0 to 100%) of the display load ratio so as to correspond to the control of switching and selecting methods in driving. For example, according to the characteristics of the respective methods, two areas, namely, the low load area (e.g., 0 to 20%) and the high load area (e.g., 20 to 100%) are preset. For example, on the basis of input image data, the display load ratio is detected and computed by the controller and driver, and according to the comparison judgment with the setting of the areas of the display load ratio, the above two methods are switched and selected by the controller and driver. Then, according to this, driving is carried out according to the switched or selected method from the driver to the electrode group including the Z electrodes of the PDP.

Further, as another control, in the case when the display load ratio is in the high load area side, a sustain discharge by the narrow pulse method to Z electrodes is used, and when the display load ratio is in the low load area side, a sustain discharge by an X-Z in-phase system is used.

Furthermore, as still another control, besides the control of combination of the above two methods according to the above setting of the two low/high display load ratio areas, a method may be used where the number of application of a pulse to be given to the Z electrodes is gradually thinned or an amplitude voltage is gradually declined according to more detailed settings and levels of the display load ratio area. For example, as the display load ratio decreases, the number of Z driving pulses in a sustain period is decreased stepwise.

Moreover, as yet another control, in a structure where an LC resonant circuit is connected to the driver of Z electrodes, the switching timing of voltage clamp after application of resonant pulses of the LC resonant circuit is delayed as the display load ratio becomes smaller.

Further, the present device detects and computes the display load ratio particularly of subfields in the display image in the above circuit, and switches sustain discharge driving waveforms of the Z electrodes per subfield according to the display load ratio of the subfields. For example, by the controller and the like, the display load ratio is detected and computed, control signals including switching and selecting the above methods are given to the driver according thereto, and pulses according to the above methods are given from the driver to the electrode group of the PDP.

The effects obtained by typical aspects of the present invention will be briefly described below. According to the present invention, to the four-electrode structure PDP, it is possible to realize improvement of luminance and an effect of reducing power consumption. In particular, in the entire area of the display load ratio of the PDP, it is possible to generate a sufficient number of times of long gap discharges with high emission efficiency in cells, so that the improvement of luminance is attained.

BRIEF DESCRIPTIONS OF THE DRAWINGS

FIGS. 1A, 1B are explanatory diagrams for comparison of a four-electrode structure PDP and a three-electrode structure PDP, in which FIG. 1A shows a cell structure of a four-electrode structure PDP according to an embodiment of the present invention and a supposed technique, and FIG. 1B shows a cell structure of a three-electrode structure PDP according to the supposed technique;

Figure 7A:
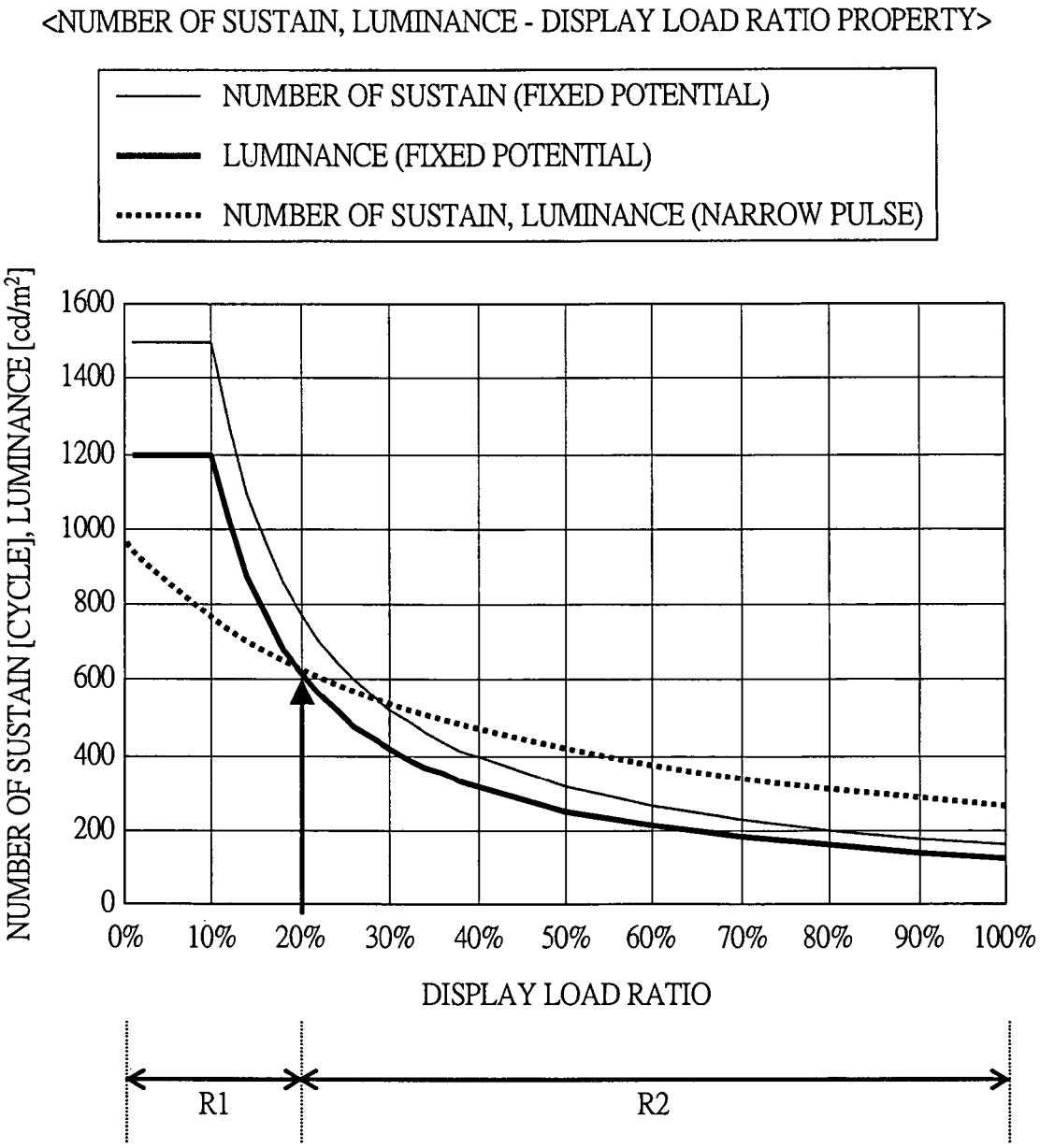
Figure 7B:
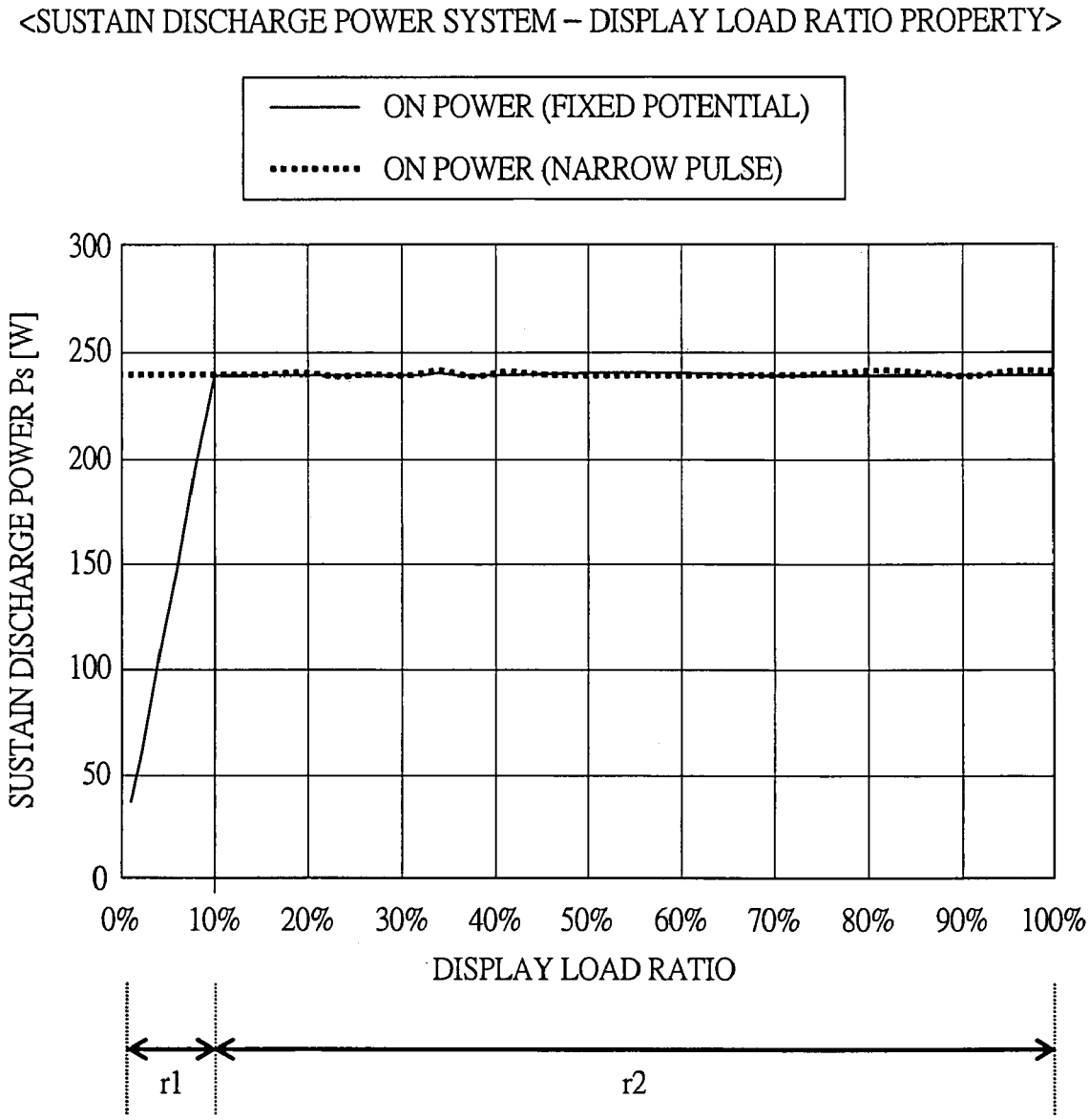
Figure 8:
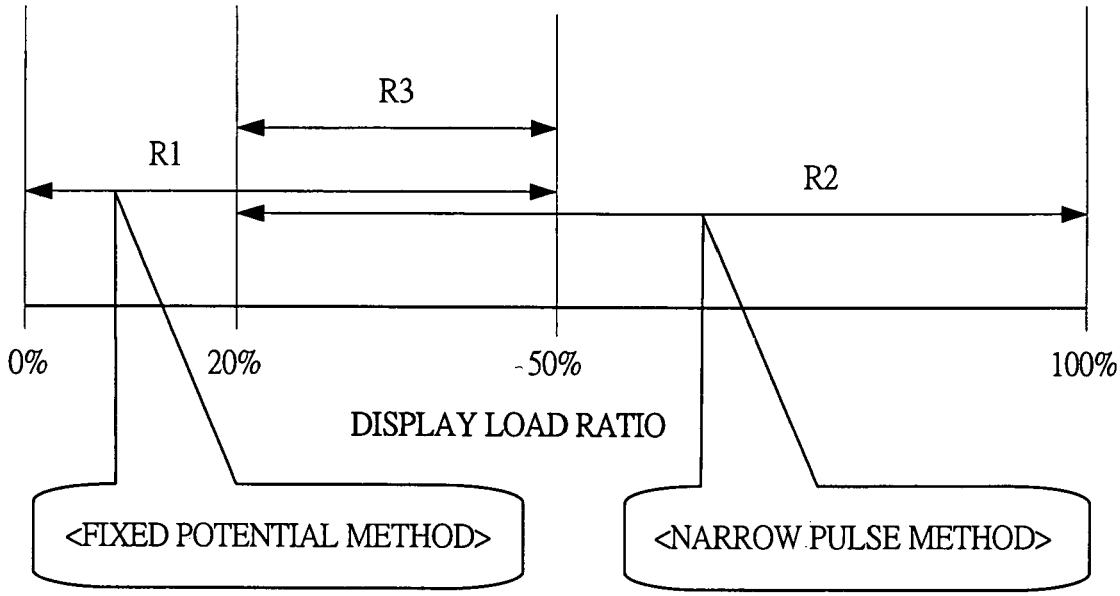
Figure 9A:
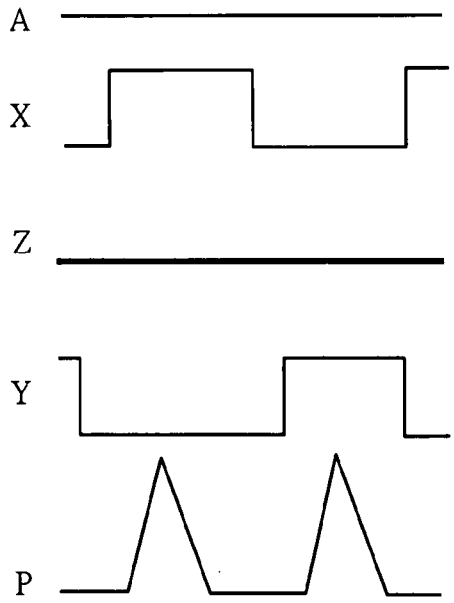
Figure 9B:
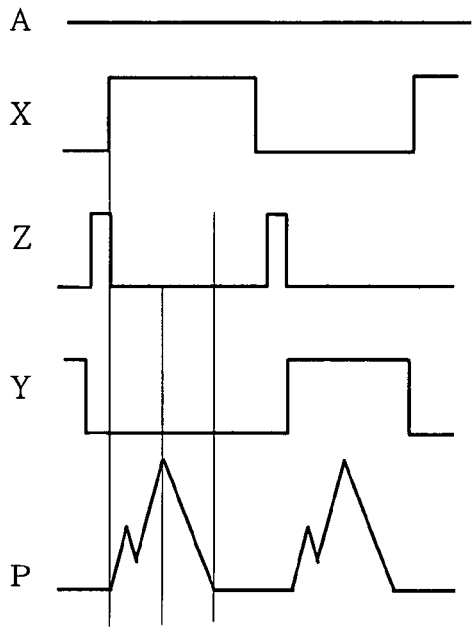

FIGS. 7A and 7B are graphs showing a forecast (simulation) of characteristics of the respective driving systems in the four-electrode structure PDP module according to the embodiment of the present invention and the supposed technique and a setting of the display load ratio area corresponding thereto, in which FIG. 7A shows characteristics of number of sustain and luminance to the display load ratios in the respective systems and FIG. 7B shows characteristics of power consumption of sustain discharge system to the display load ratios by the respective systems;

FIG. 8 is an explanatory diagram showing other setting of display load ratio range and control in the PDP module according to the embodiment of the present invention; and FIGS. 9A, 9B and 9C are explanatory diagrams showing the fixed potential method and the narrow pulse method in sustain discharge driving in the four-electrode structure PDP according to the embodiment of the present invention and the supposed technique, in which FIG. 9A shows the case of the fixed potential method, FIG. 9B shows the case of the narrow pulse method, and FIG. 9C shows a table summarizing characteristics of the above two systems.

BEST MODE FOR CARRYING OUT THE INVENTION

Hereinafter, embodiments of the present invention will be described in detail with reference to the accompanying drawings. Note that components having the same function are denoted by the same reference symbols throughout the drawings for describing the embodiment, and the repetitive description thereof will be omitted. FIGS. 1 to 9 are diagrams for explaining present embodiments of the present invention.

<Supposed Technique>

Figure 1A:
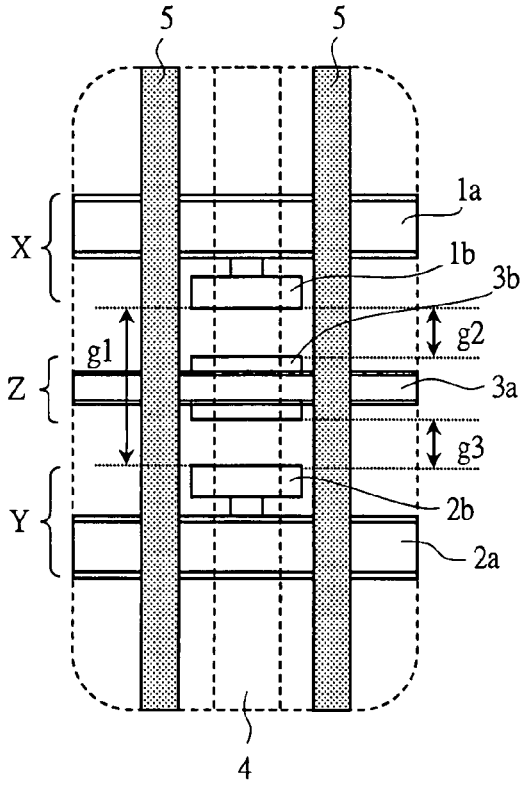
Figure 1B:
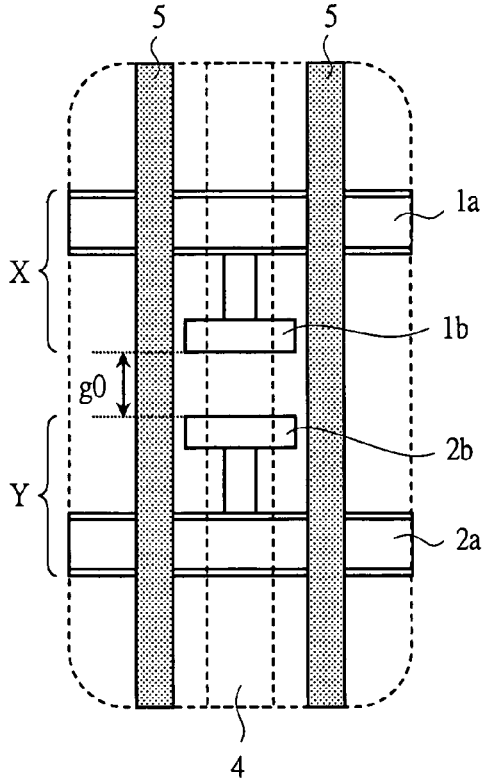

First, for comparison with the present embodiments, respective PDPs of a three-electrode structure and a four-electrode structure as structures of a supposed technique are explained hereinafter. FIGS. 1A, 1B are explanatory diagrams for comparison of the four-electrode structure and the three-electrode structure. They show part of areas corresponding to a cell unit on a substrate surface. FIG. 1A shows an example of the four-electrode structure PDP. A PDP according to the present embodiment also has such a structure. FIG. 1B shows an example of the three-electrode structure PDP.

In the conventional three-electrode structure PDP shown in FIG. 1B, X, Y electrodes for sustain discharge are arranged in parallel on a front substrate, and an address electrode 4 is arranged so as to cross them on a back substrate. As shown in FIG. 1A, in the example of the four-electrode structure PDP to realize high emission efficiency, between the X, Y electrodes of the three-electrode structure shown in FIG. 1B, further a Z electrode is arranged.

Figure 2:
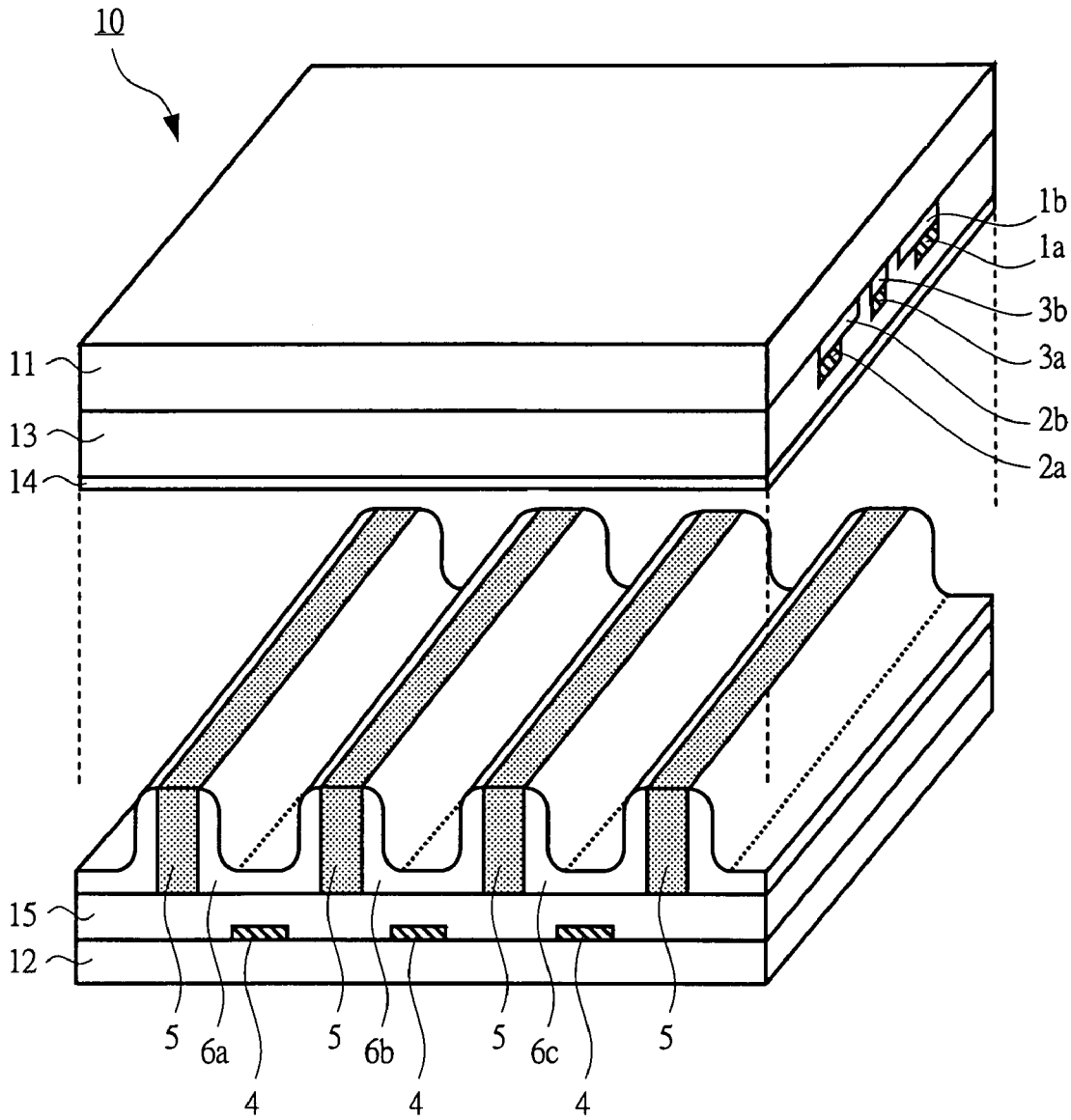
FIG. 2 is an exploded perspective view showing a part of structure of a cell unit of the four-electrode structure PDP in a PDP module according to the embodiment of the present invention and the supposed technique.

Further, FIG. 2 is an exploded perspective view showing a part of a structure of the cell unit of the four-electrode structure PDP. This structure is same in the three-electrode structure PDP except the Z electrode. The PDP according to the present embodiment also has this structure.

<Three-Electrode Structure PDP>

In FIG. 1B, in the front substrate of the PDP, a plurality of X electrodes and Y electrodes are arranged approximately in parallel in a lateral direction. Further, in the back substrate of the PDP, a plurality of address electrodes 4 are arranged in a longitudinal direction so as to cross the X, Y electrodes. Furthermore, between first and second substrates, a plurality of ribs 5 are arranged in a longitudinal stripe shape to section cells in the horizontal direction. Note that, similarly, a grid shape form where ribs are arranged so as to section cells in the longitudinal direction may also be used. To each area sectioned by the ribs 5, a phosphor layer is applied, and cells of respective colors R, G, B are configured as subpixels and a pixel are configured by a set of these subpixels.

The X electrode is comprised of an X metal electrode (referred to also as bus electrode) 1*a* and an X transparent electrode (referred to also as discharge electrode) 1*b* to be connected so as to overlap the X metal electrode 1*a*. And, the Y electrode is, in the same manner as the X electrode, comprised of a Y metal electrode 2*a* and a Y transparent electrode 2*b*. The Y electrodes function as scanning electrodes. As an address operation, by an opposing discharge between the address electrode 4 and the Y electrode, data memory of a display screen is performed. Then, as a sustain operation, by surface discharge between the XY, light emission by discharge in lighting objective cells in the display screen is performed.

The X metal electrode 1*a* and the Y metal electrode 2*a* are composed of copper and the like. The X transparent electrode 1*b* and the Y transparent electrode 2*b* are formed an ITO (indium tin oxide) layer film and the like. The respective transparent electrodes (1*b*, 2*b*) are in a T shape (or I shape) as an example as illustrated therein. Between the XY, the edges of the respective transparent electrodes (1*b*, 2*b*) opposing other electrodes are in shapes protruding from the lines of the respective metal electrodes (1*a*, 2*a*) to the inward of the cell.

Note that, not only the form (normal method) where such transparent electrodes (1*b*, 2*b*) are arranged only between $X_i$-$Y_i$ electrodes (positive slit), but also a form corresponding to so-called ALIS method where they are also arranged between $Y_i$-$X_{i+1}$ (reverse slit) may be employed.

The g0 is an interval (gap) for discharge between the XY and also a distance between edges of the respective transparent electrodes 1*b*, 2*b* of the X, Y. In general, the more the gap g0 between the XY is shorter, the more the sustain discharge voltage (Vs) becomes lower and the power efficiency becomes better, but the cell emission efficiency becomes worse. On the contrary, the more the g0 is longer, the more the cell emission efficiency becomes better, but the Vs becomes higher and the power efficiency becomes worse.

<Four-Electrode PDP>

In FIG. 1A, in the front substrate of the PDP, a plurality of X and Y electrodes are arranged roughly in parallel in the lateral direction. Further, between the respective X and Y electrodes ($X_i$-$Y_i$), the Z electrode ($Z_i$) is provided. Furthermore, in the back substrate of the PDP, a plurality of address electrodes 4 are arranged in the longitudinal direction so as to cross the above respective electrodes (X, Y, Z). Moreover, between the first and second substrate, in the same manner as in FIG. 1B, a plurality of ribs 5 are arranged, and to each area sectioned by the ribs 5, a phosphor layer 6 is applied as shown in FIG. 2, and cells of respective colors R, G, B are configured as subpixels and a pixel is configured by a set of these subpixels.

The X electrode is comprised of the X metal electrode 1*a* and the X transparent electrode 1*b* to be connected to the X metal electrode 1*a*. Further, in the same manner as the X electrode, the Y electrode is comprised of the Y metal electrode 2*a* and the Y transparent electrode 2*b*. Moreover, the Z electrode arranged between the XY is comprised of a Z metal electrode 3*a* and a Z transparent electrode 3*b* to be connected to the Z metal electrode 3*a*. The Z transparent electrode 3*b* has a protruding portion to adjacent electrodes in the same manner as the transparent electrodes 1*b*, 2*b* of the X, Y. An edge of the Z transparent electrode 3*b* opposes edges of the X transparent electrode 1*a* and the Y transparent electrode 2*a* in parallel. The protruding portion of the Z transparent electrode 3*b* in the cell is, for example, rectangular.

In the same manner as in the three-electrode structure PDP, the address operation is performed. Further, the sustain action is also performed basically in the same manner. In the four-electrode structure PDP, in a sustain discharge between the XY, first, at a narrow gap between the XZ or between the YZ, a discharge to become a trigger is carried out, and then, at a long gap between the XY, a main discharge is carried out. In order to make the cell emission efficiency better, a gap g1 between the XY is ensured to be set wide, and the Z electrodes are arranged and the power efficiency is made better by the trigger discharge.

The Z metal electrode 3*a* is composed of copper and the like. The Z transparent electrode 3*b* is formed of an ITO layer film and the like. The respective X, Y transparent electrodes (1*b*, 2*b*) are in a T shape as an example, and the Z transparent electrode 3*b* is rectangular as an example as illustrated. Between the XY, the respective X, Y transparent electrodes (1*b*, 2*b*) have a structure where the edges thereof are protruding to the Z transparent electrode. The Z transparent electrode 3*b* has a structure where the edges thereof are protruding from the line of the Z metal electrode 3*a* to the outward of the cell, that is, protruding to the X, Y electrodes. The opposing edges of the respective transparent electrodes of X, Y, Z are in parallel.

Note that, a form corresponding to so-called ALIS method where the transparent electrodes (1*b*, 2*b*) are arranged between $Y_i$-$X_{i+1}$ (reverse slit) in the same manner and further the Z electrode is arranged may also be employed.

The g1 is a long gap between the XY and is a distance between edges of the respective transparent electrodes (1*b*, 2*b*) of the X, Y. Further, g2 is a narrow gap between the XZ and is a distance between edges of the respective transparent electrodes (1*b*, 3*b*) of the X, Z. Furthermore, g3 is a narrow gap between the YZ and is a distance between edges of the respective transparent electrodes (2*b*, 3*b*) of the Y, Z.

<PDP>

The structure in FIG. 2 shows structures before sticking a front substrate side and a back substrate side of a PDP 10 of the present embodiment together and corresponds to the structure in FIG. 1A.

On the front substrate 11, the above X, Z, Y electrodes and a dielectric layer 13 and a protective layer 14 to cover those electrodes are formed. As display electrodes, the X transparent electrode 1*b* and the X metal electrode 1*a* to configure the X electrode, the Y transparent electrode 2*b* and the Y metal electrode 2*a* to configure the Y electrode, and the Z transparent electrode 3*b* and the Z metal electrode 3*a* to configure the Z electrode are formed sterically on a same layer.

Note that, with regard to the layer to which the Z electrodes are packaged in the first substrate, it may be, for example, other layer than the same layer as that of the X, Y electrodes.

On the back substrate 12, the plurality of address electrodes 4 and a dielectric layer 15 to cover these are packaged. Further, above the back substrate 12, between the front substrate 11 and the back substrate 12, the plural ribs 5 which section the panel surface in a lateral direction of the PDP 10 corresponding to the cells are formed. To each space sectioned by the respective ribs 5, phosphor layers 6*a*, 6*b*, 6*c* of respective colors corresponding to subpixels of the respective colors, for example, R, G, B are applied. The front substrate 11 and the back substrate 12 are sticked together so as to oppose each other, and into the space therebetween, air is discharged and a discharge gas is filled and sealed, so that the PDP 10 is structured.

Further, the above PDP 10, and a driver module including a flexible wiring substrate packaging an IC chip to become the controller and driver, a chassis and the like are connected so that a plasma display device is structured.

The mechanism of the sustain discharge in the form of the above four-electrode structure PDP is as follows. As a trigger discharge in sustain discharge, a voltage is applied between the Z electrode and the X electrode (or the Y electrode), and a gas ionization process is generated, so that the electric charge density in the cell space is increased beforehand. By this ionization process, it is possible to stably generate a long gap discharge between the XY at a low voltage (Vs).

If the long gap discharge between the XY can be generated at a low voltage (i.e., at a low electron temperature), it is possible to use emission of the positive column area so that the loss of excitation energy becomes small and the emission efficiency is improved. Thus, the point of the high emission efficiency by the four-electrode structure PDP lies in that the long gap discharge is generated at a low voltage.

As the sustain discharge driving method to the Z electrodes in the four-electrode structure PDP, there are two as shown below. FIG. 9 shows the two systems as the supposed techniques, in which FIG. 9A shows the narrow pulse method and FIG. 9B shows the fixed potential method. The PDP module of the present embodiment uses these methods. The respective methods will be explained hereinafter. FIGS. 9A, 9B show driving waveforms and discharge emission for one cycle of the sustain discharge driving. Further, FIG. 9C summarizes the characteristics of these two methods.

<Fixed Potential Method (First Method)>

In the fixed potential method shown in FIG. 9A, a potential of the Z electrodes is fixed, and a sustain pulse (i.e., an alternate pulse for sustain discharge drive) is given to the X, Y electrodes. Therefore, first, a discharge to become a trigger is started at the narrow gap between the ZX (or YZ), and then it is developed to a long gap discharge takes place between the XY. Consequently, it is possible to generate the long gap discharge at a lower voltage (Vs) than in the case of the long gap three-electrode structure PDP not having the Z electrode.

In the sustain period, the potential is fixed at the address electrodes (A) 4 because it is driven in the address period. In the X and Y electrodes, sustain pulses that become mutually reverse phases are applied. The potential of the Z electrode is fixed. According to the driving to respective electrodes, discharge emission shown by P appears.

<Narrow Pulse Method (Second Method)>

In the narrow pulse method shown in FIG. 9B, to the Z electrodes, a narrow pulse, i.e., a pulse whose time width at a Hi voltage is short is given at an appropriate timing, and thereby generating a long gap discharge at a low voltage (Vs). Further, in the discharge of this narrow pulse method, in response to the voltage changes of the rise/fall of the pulse applied to the Z electrodes and the rise of the sustain pulse between the XY, a multistage discharge process is performed. As shown by P, multistage discharges including the long gap discharge is maintained by a low instantaneous discharge current and at low Vs. Therefore, even with a same long gap discharge, it is possible to realize a discharge with a higher energy use efficiency in the narrow pulse method than in the fixed potential method. However, in the narrow pulse method, pulses are applied to the Z electrodes, therefore, the reactive power for driving increases more than the fixed potential method by that much.

In the narrow pulse method, in the case where the display load ratio in the display image of the PDP screen is large and the number of sustain becomes small due to operations of power control such as APC (automatic power control) and the like, in other words, in the case when the gas discharge power occupies nearly half of the power consumption of the sustain discharge system, the effect of luminance improvement is large. The power consumption of the sustain discharge system consists of, basically, the gas discharge power and the reactive power. In other words, it is considered that <power consumption of sustain discharge system (Ps)>=<gas discharge power at display electrode>+<reactive power>. The gas discharge power depends on the display load ratio. The reactive power is a power that circuits use for pulse application and the like, and is in proportion with the number of sustain.

Note that, the number of sustain is the number of times (number of cycles) or driving frequency of sustain pulse application in the sustain period of fields and subfields.

In the case when the driving methods are switched per subfield, it is necessary to adjust the number of sustain per subfield to control grayscale.

The APC is briefly explained. Basically, the power increases as the display load ratio increases. However, if the power becomes too high due to a high display load ratio, it may become a problem. Therefore, in APC, a limitation of power usage is set, and the power in circuits is controlled so that the power increases until the display load ratio becomes a certain limit, and over the range, the power is limited to a constant value.

As shown in FIG. 9C, when the characteristics of the above respective methods are compared relatively, the fixed potential method has characteristics that the reactive power is small and the discharge power is rather large. The narrow pulse method has characteristics that the reactive power is rather large and the discharge power is small.

<Characteristics>

FIG. 7B shows a forecast of characteristics of the power (lighting power of the sustain discharge system) corresponding to the display load ratio in the above two methods. As an example, the upper limit value of the number of sustain is set to be 1500 cycles, and the upper limit value of the sustain system power (Ps) is set to be 240 W. The solid line shows the case of the fixed potential method, and the dot line shows the case of the narrow pulse method. In the case of the narrow pulse method, the power is roughly constant over the entire display load ratio range. In the case of the fixed potential method, in the range (r1) where the display load ratio is up to about 10%, the power (Ps) [W] of the sustain discharge system increases proportionally. Meanwhile, in the range (r2) over that, it is shown that a power control is carried out by APC so that the power (Ps) becomes about 240 W as the limit or below that is roughly constant.

FIG. 7A shows a forecast of characteristics of the number of sustain and the luminance corresponding to the display load ratios in the above respective two methods. The solid line shows the case of the fixed potential method, and the dot line shows the case of the narrow pulse method. Further in the fixed potential method, the thin solid line shows the number of sustain ([cycle]), and the thick solid line shows the luminance ([cd/m$^2$]). In the narrow pulse method, on the assumption that the luminance is 1 cd/m$^2$ per one cycle of sustain, the number of sustain and the luminance is shown by one dot line in the graph.

In the fixed potential method, in the range (the above r1) where the display load ratio is up to a certain degree (e.g., 10%), the number of sustain is constant. In the range over a certain degree (e.g., 10%) (the above r2), the number of sustain and the luminance decrease. Further in the narrow pulse method, the number of sustain and the luminance decreases in accordance with the display load ratio.

The entire range of the display load ratio (0 to 100%) can be roughly divided into two ranges (corresponding to FIG. 6 to be described later). As the characteristics, it may be said that in the range (R1) where one display load ratio is relatively low, the reactive power is large and the discharge power (power of sustain discharge system) is small. On the contrary, it may be said that in the range (R2) where the other display load ratio is relatively high, the reactive power is small and the discharge power is large.

In FIG. 7A, at the portion where the display load ratio is about 20%, the levels of respective luminance of the fixed potential method and the narrow pulse method trade places. That is, it can be said that, in this range (R1) equal to or below about 20% and the range (R2) equal to or over that, the effective system is different in a viewpoint of the luminance (emission efficiency). Accordingly, in the present embodiment, with this display load ratio (20%) as a reference, the display load ratio ranges are set by sectioning.

First Embodiment

In consideration of the foregoing, a structure of a first embodiment will be described hereinafter. In the first embodiment, according to settings of display load ratio and display load ratio ranges, the above two systems are switched and selected by controllers, so that drivers are controlled. From drivers to electrode group of the PDP, pulses according to the systems are applied.

<PDP Module>

Figure 3:
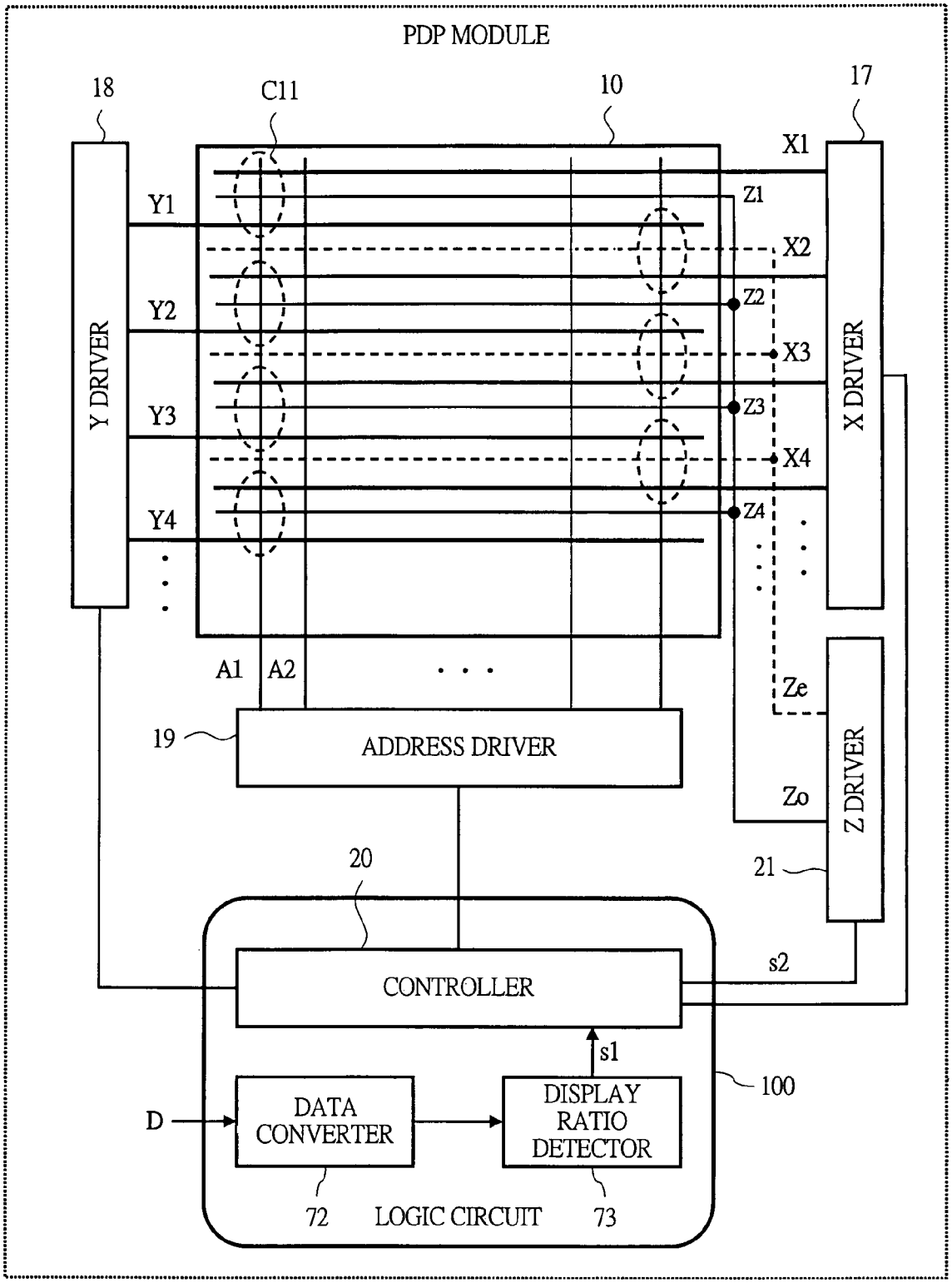
FIG. 3 is a diagram showing a structure of a PDP module according to an embodiment of the present invention.

FIG. 3 is a diagram showing a structure of a four-electrode structure PDP module according to the present embodiment, in particular, a structure of the electrodes and the drivers and controllers of the PDP 10 as a structure of a four-electrode structure PDP module according to the present embodiment. The present PDP module has a structure comprising a logic circuit 100 which includes the PDP 10, respective electrode drivers (17, 18, 19, 21), a controller 20 and the like.

Detailed structure of the PDP 10 is shown in FIG. 2 described above. In the front substrate 11, electrodes {X1 to Xm}, and electrodes {Y1 to Ym} are provided. In the back substrate 12, the address electrodes (A) 4 are provided. The number of electrodes m is, for example, 1024. Between the X, Y electrodes, Zo electrode {Z1 to Zm} are arranged at the positive slit side. Ze electrodes may also be arranged at the reverse slit side in the same manner.

The respective drivers include an X driver 17, a Y driver 18, an address driver 19 which respectively drive the X electrodes, the Y electrodes, the address electrodes in the PDP 10. And in addition, they include a Z driver 21 to drive the Z electrodes.

In the logic circuit 100, mainly by a controller 20 which controls the entire display, control signals are sent to these drivers (17, 18, 19, 21) and driving is controlled. The logic circuit 100 includes the controller 20, a data converting circuit 72, and a display-rate detecting circuit 73. The controller 20 is structured by, for example, an IC which drives and controls the X, Y, Z electrodes and an IC which drives and controls the address electrodes 4. The data converting circuit 72 performs a necessary data conversion on the basis of image data (D) inputted from the external and creates display data.

In the inside of the logic circuit 100, by the display-rate detecting circuit 73, the display load ratio is detected and calculated on the basis of the image data inputted from the external or the display data from the data converting circuit 72. Further, in the controller 20, ranges of display load ratio are preset.

In the present embodiment, on the basis of a value (s1) of the display load ratio detected by the display rate detecting circuit 73, the range of display load ratio is judged by the controller 20 and the number of sustain and a Z driving pulse width and the like are computed. Accordingly, control signals and the like are sent to the respective drivers (17, 18, 19, 21) and the display drive to the PDP 10 is controlled. In particular, from the controller 20 to the Z driver 21, a switching control signal (s2) of the system corresponding to the display load ratio is sent. According to this, the driving system from the Z driver 21 to the Z electrodes of the PDP 10 is switched between the fixed potential method and the narrow pulse method to drive.

Driving is available from the X driver 18 to the electrodes $X_n$ (for example, n=1 to 1024). Driving is available from the Y driver 19 to the electrodes $Y_n$ (for example, n=1 to 1024). Further, Driving is available from the address driver 19 to the address electrodes $A_m$ (for example, m=1 to 1024×3.

The Z driver 21 has a circuit structure capable of performing drivings in any of the two systems to the Z electrodes of the PDP 10. Driving is available from the Z driver 21 to electrodes $Z_i$ (for example, n=1 to 1024) between $X_i$-$Y_i$ (positive slit side) by the line shown by Zo (odd-number electrodes). In the Zo side, in the same manner as a cell C11 formed of {X1, Z1, Y1, A1}, a plurality of cells are configured.

Note that, driving may be available from the Z driver 21 also to the Z electrodes between $Y_i$-$X_{i+1}$, (reverse slit side) by the line shown by Ze (even-number electrodes). In the Ze side, a plurality of cells may be structured in the same manner as in the Zo side. In this manner, display is carried out with dividing time by the odd number lines and even number lines, so-called interlace scan is available. Hereinafter, the PDP 10 in the present embodiment is described as a form where only the Zo side is packaged. However, the drive control method shown in the present embodiment may also be applied to a form where both the Zo and Ze are packaged.

The Y electrodes function as scanning electrodes. At the address operation, scan pulses are applied sequentially from the Y driver 18 to the Y electrodes, and in sync with that, data signals are applied from the address driver 19 to the address electrodes (A) 4.

<Driving Waveform>

Figure 4:
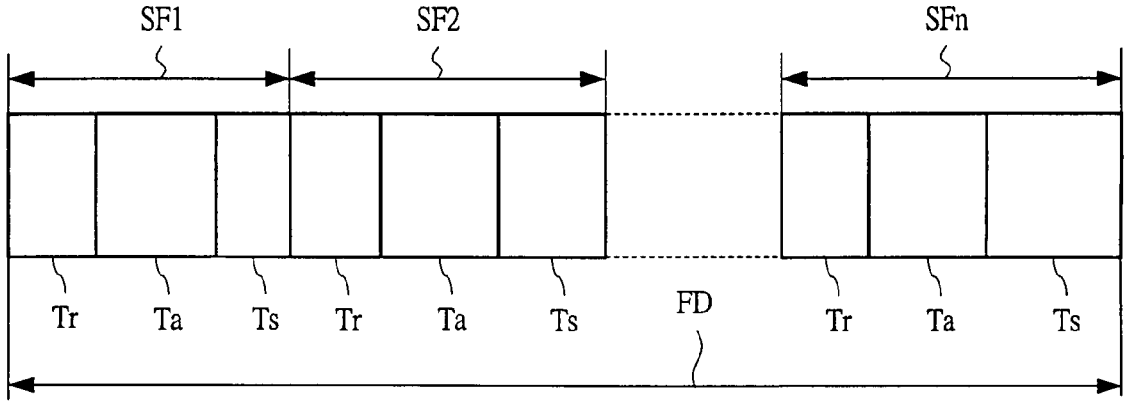
FIG. 4 is an explanatory diagram showing a subfield division structure in the PDP module according to the embodiment of the present invention.
Figure 5:
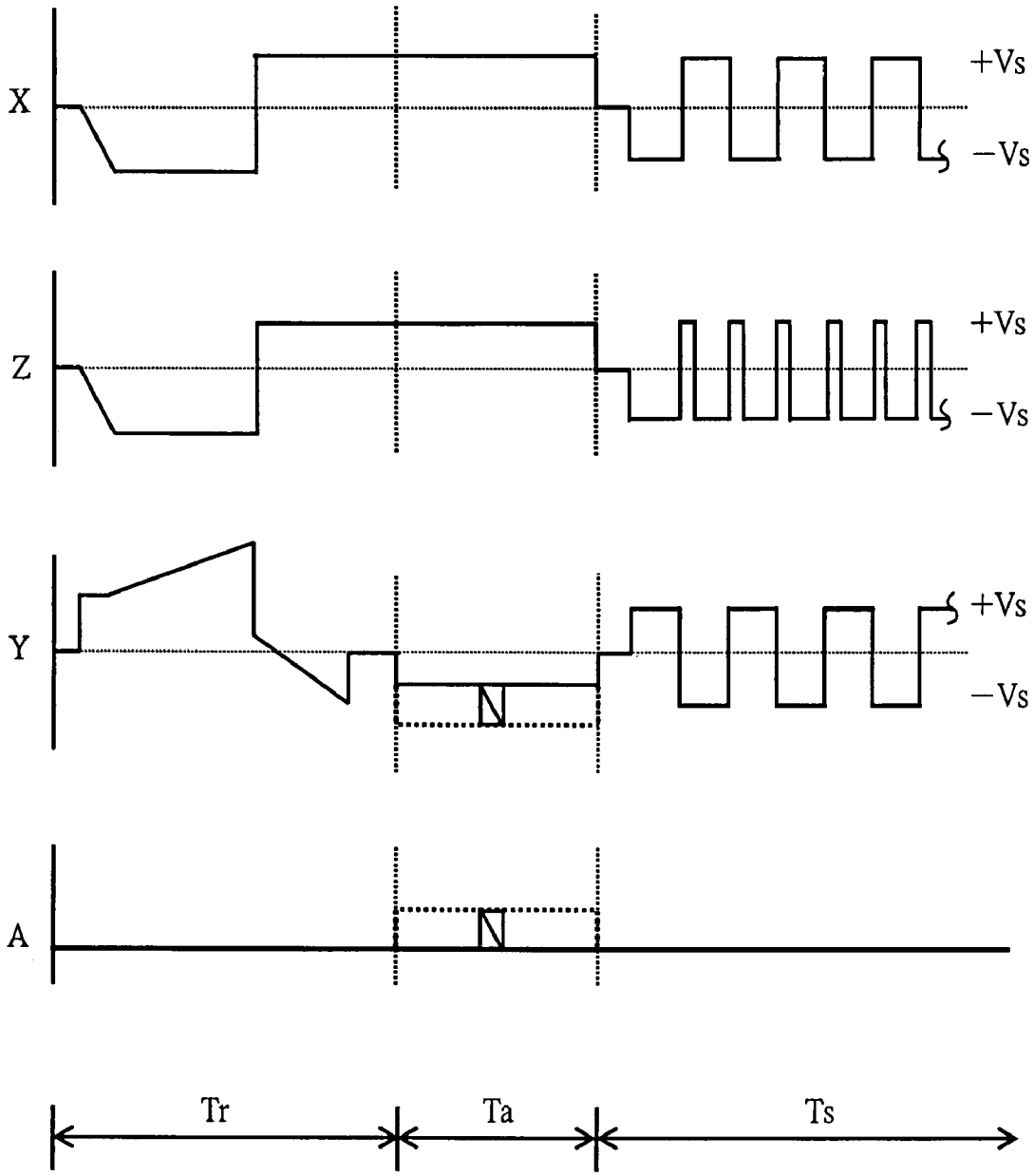
FIG. 5 is a diagram showing driving waveforms of one subfield in the PDP module according to the embodiment of the present invention, in particular, in the case when the narrow pulse method is used.

In FIG. 4 and FIG. 5, an example of driving waveforms to the PDP 10 in the PDP module according to the present embodiment is shown. FIG. 4 shows a subfield division configuration. FIG. 5 shows an example of driving waveforms of one subfield (in the case of the narrow pulse method). Note that, in the entire display screen of the PDP 10, it stands that one frame=one field.

In FIG. 4, in the same manner with the general three-electrode structure PDP shown in FIG. 1B, one field (FD) is divided into a plurality of subfields (SF1 to SFn) in the four-electrode structure PDP 10. For example, the number of SF n is 10. By turning ON/OFF of the respective SF, grayscale control is performed. Respective SFs include a reset period Tr, an address period Ta, and a sustain period Ts. In the address period Ta, charging for data memory is carried out to the entire SFs. In other words, the objective display cells are made into an active state. In the sustain period Ts, a sustain pulse is applied to the X, Y, Z electrodes and a sustain discharge is carried out. And at cells in the active state, light emission is made. In the reset period Tr, the display of the entire SFs is reset by a predetermined pulse. Corresponding to the grayscale control, the sustain period Ts is different in respective SFs.

The driving waveforms shown in FIG. 5 is an example of the display drive at use of the narrow pulse method previously described. In the present PDP module, the driving waveforms in accordance to the conventional three-electrode structure PDP is applied for the X, Y electrodes and the address electrodes (A) 4, and the same (in-phase) driving waveforms as those of the X electrodes are applied for the Z electrodes in the reset period Tr and the address period Ta, meanwhile narrow pulses are applied in the sustain period Ts. According to the present control, in the case to use the above fixed potential method, it is changed to a fixed potential in the sustain period Ts of the Z electrode driving waveform.

<Display Load Ratio>

In the PDP module according to the present embodiment, in a display-rate detecting circuit 73 of the logic circuit 100, the display load ratio (s1) of respective subfield in the field is detected. Then, by the controller 20, the sections (R1, R2) of the range of the detected display load ratio (s1) are judged, and the two systems are switched in correspondence to the ranges (R1, R2). In order to drive sustain discharge in any of the two systems, from the controller 20 to the Z driver 21, the switching control signal (s2) according to the method to be selected is given. Then, from the Z driver 21, in sustain discharge drive to the Z electrodes of the PDP 10, a pulse according to the switching control signal (s2) is switched to drive. In other words, when the fixed potential method is designated from the controller 20, a fixed potential is given from the Z driver 21 to the Z electrodes, and when the narrow pulse method is designated, a narrow pulse as shown in FIG. 5 is applied from the Z driver 21 to the Z electrodes at appropriate timing.

As described above, the characteristics of the luminance and the power consumption with respect to the display load ratio differ in the fixed potential method and the narrow pulse method. Therefore, in the example shown in FIG. 7, in the range (R1) where the display load ratio is below 20%, a higher luminance can be obtained in the sustain discharge driving of the Z electrodes—fixed potential method, meanwhile in the range (R2) where it is 20% or more, a higher luminance can be obtained in the sustain discharge driving of the Z electrodes—narrow pulse method. Therefore, if a control is made so as to switch the above two methods in correspondence to the ranges (R1, R2), high luminance can be obtained comprehensively in the entire display load ratio ranges and also the power consumption is reduced.

Further, as the display load ratios to be used in the control in the present PDP module, there may be, for example, two rates, i.e., display load ratio in a unit of subfield and display load ratio in a unit of field.

First, the display load ratio in the unit of subfield is a rate of ON cells in one subfield. The display load ratio of the subfield SFx is defined as ax. The number of subfields in one field is n.

Next, the display load ratio (APL) in the unit of field reflects the difference of the sustain period Ts per subfield and is calculated as shown below. Per subfield SFx, the number of sustain is defined as sx, the luminance weight is defined as wx, and the display load ratio in the unit of subfield is defined as the above αx. Note that, x takes 1 to n. As for the luminance weight w, it stands that w1+ . . . +wn=1. Here, the luminance weight wx of the subfield SFx is calculated by the following (Equation 1).

$$wx=sx/(s1+\ldots+sn) \quad \text{(Equation 1)}$$

Then, the display load ratio (APL) in the unit of field is calculated by the following (Equation 2).

$$APL=\alpha 1\cdot w1+\alpha 2\cdot w2+\ldots+\alpha n\cdot wn \quad \text{(Equation 2)}$$

It is possible to improve the luminance more by the method to switch the sustain method per subfield according to the display load ratio in the unit of subfield than by the method to switch the sustain method per field according to the display load ratio in the unit of field. However, for the grayscale display, it is necessary to adjust the SF allocation of the number of sustain.

Figure 6:
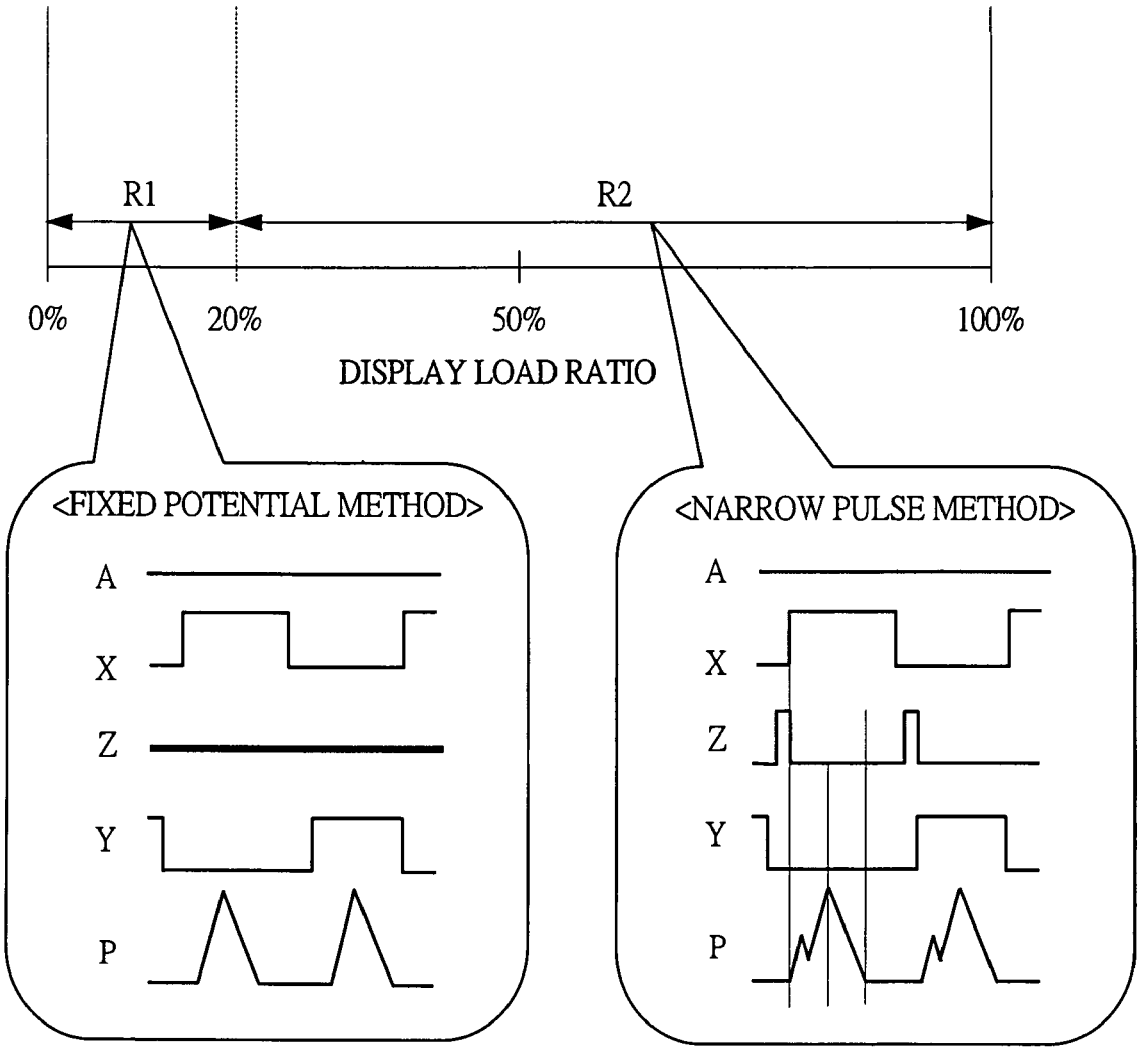
FIG. 6 is an explanatory diagram showing a setting of display load area and a control of driving method switching in the PDP module according to the embodiment of the present invention.

FIG. 6 shows the control of method switching and the setting of range of display load ratio in the PDP module according to the present embodiment. In consideration of FIG. 7 described above, two ranges of display load ratio of the above ranges R1, R2 are set. In the present control, when it is judged that the display load ratio is in the range R1 on the basis of inputted video data in the logic circuit 100, the fixed potential method is selected. And when it is judged that it is in the range R2, the narrow pulse method is selected. The properties of the methods in use are shown in FIG. 7.

FIG. 8 shows ways of other setting and control different from the control and setting in FIG. 6. FIG. 6 is the case when the range is divided simply into two of the low load range (R1) and the high load range (R2). But the present invention is not limited to this and a plurality of ranges may be set and controlled stepwise. In FIG. 8, there is shown a case where an intermediate load range (R3) that overlaps the two ranges (R1, R2) is arranged. Or an intermediate range that does not overlap these may be arranged in the same manner. In this case, three kinds of ranges are set in the entire display load ratio range.

In the above sustain discharge drive control, for example, in the range (R3), any of the two methods may be used. As an example, the range (R1) where the display load ratio is 0 to 50%, the range (R2) where the display load ratio is 50 to 100%, and the range (R3) where the display load ratio is 20 to 50% are set. A control example is as described below. In the range R2, the above narrow pulse method is used, and gradually as a timewise display, the display load ratio shows a tendency to decline from 50% to 20%. At this stage, in the range R3, the above narrow pulse method is used continuously. Then, when the display load ratio declines to the range R1 below 20%, the method is switched to the above fixed potential method. Further, when the display load ratio shows a tendency to increase from 20% to 50%, herein in the range R3, the above fixed potential method is used continuously.

Then, when the display load ratio increases to the range R2 over 50%, the method is switched to the above narrow pulse method.

Second Embodiment

Next, as another embodiment according to the present invention, a second embodiment is described hereinafter. The above narrow pulse method uses narrow pulses to the Z electrodes at every time of discharge. Meanwhile, in the second embodiment, at the moment of application of the Z electrode driving pulses at the use of the narrow pulse method to the Z electrodes (hereinafter, referred to as Z pulses), the number of sustain is determined for driving so that the Z pulses are thinned out stepwise according to the degree of the display load ratio.

As an example, from the Z driver 21, Z pulses are applied every other time of discharge, and Z pulses are applied every couple of discharges, and thus, the number of sustain is determined for driving so that the Z pulses are thinned out stepwise according to the decrease of the display load ratio. Consequently, an intermediate range (such a range as R3 shown in FIG. 8) of the two ranges (R1, R2) in the entire display load range is optimized, and the effect to improve the luminance is expected.

Third Embodiment

Next, a third embodiment according to the present invention is described hereinafter. In the above second embodiment, an example where Z pulses are thinned out stepwise with respect to the decrease of the display load ratio and the number of sustain is charged is shown. Meanwhile, in the third embodiment, in the same manner as in the second embodiment, according to the degree of the display load ratio, not the number of application times of the Z pulses but an amplitude voltage is changed stepwise.

As an example, from the Z driver 21, driving waveforms are determined for driving with respect to the decrease of the display load ratio, so that the amplitude voltage of Z pulses are decreased stepwise. Therefore, it is possible to reduce the reactive power in circuits and provide the number of sustain, that is, it enables applying much more sustain pulses.

Fourth Embodiment

Next, a fourth embodiment according to the present invention is described hereinafter. In the narrow pulse method to the Z electrodes, in order to obtain a high emission efficiency, it is indispensable to make the width of impression pulse thin. As a conventional art, concerning the driver such as the Z driver 21, there is a structure where an LC resonant circuit (LC resonant power recovery circuit) is provided.

As the main reason of the large reactive power of Z pulse, there is a Lo voltage clamp. Clamp is a forcible fall. In the time width (cycle) of one pulse, the narrower the width is, the better the emission efficiency is. Therefore, conventionally, clamp action to forcibly make a fall to the Lo voltage in the course of one pulse is carried out. However, for execution of clamp to this Lo voltage, power consumption increases.

In the case when narrow pulses to Z electrodes are generated by use of the LC resonant circuit, after rising pulse by LC resonance in the LC resonant circuit, pulse fall is waited by LC resonance. When it is clamped to Lo voltage, the power recovery efficiency is good and the increase of reactive power can be suppressed. However, since the width of Z pulse becomes thick, the emission efficiency declines. In order to obtain a high emission efficiency, thin pulse (around 300 ns at half width) is necessary. But for that purpose, it is necessary to sacrifice the power recovery efficiency of the Z pulse, that is, to sacrifice the reactive power, and clamp to Lo voltage at early stage.

In consideration of the foregoing, in the fourth embodiment, in the control at use of the narrow pulse method to the Z electrode, according to the decrease of the display load ratio, the timing of clamp to Lo voltage is delayed gradually. Thereby, the reactive power is reduced and the number of sustain is charged, and the effect to improve the luminance at low load is expected.

Fifth Embodiment

Next, a fifth embodiment according to the present invention is described hereinafter. As a method of sustain discharge driving of the four-electrode structure PDP, there is also a method where the same sustain pulse as that to the X electrodes (or the Y electrodes) is applied to the Z electrodes (referred to as X-Z in-phase method).

In the case of this X-Z in-phase method, as the behavior of sustain discharge, potentials on the Z electrodes and the X electrodes look as if they shift together, that is, a sustain discharge takes place between the Z electrodes and the Y electrodes (gap g3 between YZ). Although this does not become a highly efficient long-gap discharge (discharge at the gap g1 between XY), since it is a narrow gap, discharge may be generated by Vs lower than that in the fixed potential method. Further, the capacitance between electrodes between the Z electrodes and the X electrodes can not be seen, the reactive power does not increase as in the above narrow pulse method.

Therefore, in the fifth embodiment, switching control is carried out so that a sustain discharge of the X-Z in-phase system is used in the low load range (R1) as shown in FIG. 6 and the narrow pulse method to the Z electrodes is used in the high load range (R2). The X-Z in-phase system and the narrow pulse method to the Z electrodes can be driven by Vs lower than that in the fixed potential method. Therefore, according to the combination of the methods in the fifth embodiment, it is possible to set Vs lower than that in the first embodiment and further improve the emission efficiency of the narrow pulse method to the Z electrodes.

As described in the foregoing, according to the respective embodiments of the present invention, by the switching control of the method of drive to the electrodes of the PDP 10 in the PDP module, in particular the methods of the sustain discharge driving to the Z electrodes, the balance between luminance and power consumption in the entire display load range is taken, therefore it is possible to improve the comprehensive luminance and reduce the power consumption of the PDP. In particular, in the application of the above control in the four-electrode structure PDP 10, it is possible to generate a sufficient number of times of high emission efficiency long-gap discharges so that luminance is improved.

In the foregoing, the invention made by the inventors of the present invention has been concretely described based on the embodiments. However, it is needless to say that the present invention is not limited to the foregoing embodiments and various modifications and alterations can be made within the scope of the present invention.

INDUSTRIAL APPLICABILITY

The present invention can be used for a display device having a four-electrode structure panel and the like.

The invention claimed is:

1. A plasma display device comprising:

a plasma display panel including opposing first and second substrates sectioned by barrier ribs and a phosphor layer arranged between the barrier ribs, and a discharge space filled with a discharge gas; and a circuit driving an electrode group which is formed in the plasma display panel, wherein:

in the first substrate, a plurality of first and second electrodes are arranged roughly in parallel alternately in a first direction, and a third electrode is arranged between the first and second electrodes, in the second substrate, a fourth electrode is arranged so as to cross the first, second, and third electrodes in a second direction, and in a sustain period, the circuit applies sustain pulses of a number corresponding to a display load ratio to the first and second electrodes, and the circuit supplies a fixed potential to the third electrode when the display load ratio is low and the number of the sustain pulses is large, or the circuit applies a narrow pulse having a width narrower than that of a sustain pulse when the display load ratio is high and the number of the sustain pulses is small.

2. The plasma display device according to claim 1, wherein:

an entire range of the display load ratio is divided into a first range of low display load, a second range of high display load, and a third range positioned in a range therebetween or overlapped thereon; and to the third electrode, the circuit applies the fixed potential when the display load ratio is in the first range, applies the narrow pulse when the display load ratio is in the second range, and applies either of the fixed potential or the narrow pulse when the display load ratio is in the third range.

3. The plasma display device according to claim 1, wherein the circuit decreases a rate of the number of sustain pulses between application times of the narrow pulse to the third electrode to the number of application times of sustain driving pulse to the first and second electrodes in the sustain period stepwise as the display load ratio becomes low.

4. The plasma display device according to claim 1, wherein the circuit decreases an amplitude voltage of the narrow pulse applied to the third electrode in the sustain period stepwise as the display load ratio becomes low.

5. The plasma display device according to claim 1, wherein the circuit forms a falling waveform of the narrow pulse by an LC resonant circuit to the third electrodes, and delays a timing of clamp to a lower potential as the display load ratio becomes low.

6. A plasma display device according to claim 1, wherein the circuit detects or calculates the display load ratio of a subfield of display image, and according to the display load ratio of the subfield, switches and applies either the fixed potential or the narrow pulse per the subfield.

* * * * *